US007597106B2

(12) United States Patent
Desmond et al.

(10) Patent No.: US 7,597,106 B2
(45) Date of Patent: Oct. 6, 2009

(54) HAIR TREATMENT APPLICATOR

(75) Inventors: Elizabeth Eileen Desmond, Reading (GB); Julian Richard John Gruzelier, Salisbury (GB); David Richard Hayman, Twickenham (GB); Osma Iqbal, Reading (GB)

(73) Assignee: The Procter & Gamble Company, Cincinnati, OH (US)

( * ) Notice: Subject to any disclaimer, the term of this patent is extended or adjusted under 35 U.S.C. 154(b) by 535 days.

(21) Appl. No.: 11/359,716

(22) Filed: Feb. 22, 2006

(65) Prior Publication Data

US 2006/0289026 A1 Dec. 28, 2006

(30) Foreign Application Priority Data

Jun. 22, 2005 (EP) ..... 05013431

(51) Int. Cl.
*A45D 24/22* (2006.01)
*A45D 24/04* (2006.01)

(52) U.S. Cl. ..... 132/112; 132/142

(58) Field of Classification Search ..... 132/112–116, 132/139, 140, 141, 158, 126
See application file for complete search history.

(56) References Cited

U.S. PATENT DOCUMENTS

| | | | | |
|---|---|---|---|---|
| 1,161,719 | A | 11/1915 | Norton | |
| 1,624,753 | A | 4/1927 | Dios | |
| 1,628,577 | A * | 5/1927 | Burke | 132/139 |
| 1,675,754 | A * | 7/1928 | Grom | 132/139 |
| 1,877,538 | A * | 9/1932 | Scheiwer | 132/139 |
| 1,921,328 | A * | 8/1933 | Shaw | 132/141 |
| 1,988,866 | A * | 1/1935 | Compan | 132/141 |
| 2,292,357 | A | 8/1942 | Yates | |
| 3,960,160 | A | 6/1976 | Hogan | |
| 4,030,845 | A * | 6/1977 | Deckert | 401/268 |
| 4,211,247 | A | 7/1980 | Morganroth | |
| 4,237,822 | A | 12/1980 | Kaiser, Jr. | |
| 4,399,827 | A | 8/1983 | Fuhs | |
| 4,427,001 | A | 1/1984 | Kiefer | |
| 4,492,223 | A | 1/1985 | Burke | |
| 4,566,472 | A | 1/1986 | Mueller | |
| 4,605,026 | A | 8/1986 | Nolin | |
| 5,062,435 | A | 11/1991 | Ohtsuka | |
| 5,311,887 | A | 5/1994 | Ramsey | |
| 5,337,765 | A | 8/1994 | Wong | |
| 5,383,244 | A * | 1/1995 | Ahrens et al. | 15/106 |
| 5,561,856 | A | 10/1996 | Pesco | |
| D394,730 | S | 5/1998 | Olsson | |
| 6,047,703 | A | 4/2000 | Paglericcio | |

(Continued)

FOREIGN PATENT DOCUMENTS

FR 2645725 A1 10/1990

(Continued)

*Primary Examiner*—Robyn Doan
(74) *Attorney, Agent, or Firm*—Melissa G. Krasovec

(57) ABSTRACT

There is provided a hair treatment applicator (1) for applying a hair treatment product to hair. The applicator comprises:

a handle (2) comprising a first extremity and a second extremity; and a first retaining structure (3*a*) and a second retaining structure (3*b*) for receiving, retaining and spreading said hair treatment product, both retaining structures being connected to said handle.

The first retaining structure and the second retaining structure are located at the first extremity and the second extremity, respectively, and the retaining structures are different from one another.

4 Claims, 1 Drawing Sheet

U.S. PATENT DOCUMENTS

| | | | | |
|---|---|---|---|---|
| 6,079,420 | A | 6/2000 | Musum | |
| 6,142,157 | A | 11/2000 | De Laforcade | |
| 6,165,145 | A | 12/2000 | Noble | |
| 6,245,031 | B1 | 6/2001 | Pearson | |
| 6,250,312 | B1 | 6/2001 | Dasilva | |
| 6,286,518 | B1 | 9/2001 | Laporte | |
| 6,453,909 | B1 * | 9/2002 | De Laforcade | 132/208 |
| 6,500,135 | B2 | 12/2002 | Huang | |
| D471,669 | S * | 3/2003 | Kim et al. | D28/29 |
| 6,688,314 | B1 | 2/2004 | Hoeffkes | |
| 2003/0200619 | A1 | 10/2003 | Kelsey | |
| 2004/0065338 | A1 | 4/2004 | Colacioppo | |
| 2005/0241661 | A1 * | 11/2005 | Eddinger et al. | 132/139 |

FOREIGN PATENT DOCUMENTS

| | | |
|---|---|---|
| GB | 2237036 A | 4/1991 |
| JP | 2003206217 | 7/2003 |

* cited by examiner

HAIR TREATMENT APPLICATOR

FIELD OF THE INVENTION

The present invention relates to hair treatment devices. More particularly, the present invention relates to an applicator for applying a hair treatment product, such as a hair colorant or preferably a product for the bleaching of selected strands of hair.

BACKGROUND OF THE INVENTION

Applicators for applying a hair treatment product to hair are known. There are typically two types of applicator. The first type of known applicator comprises a handle and a retaining structure connected to said handle. In this design, the structure is for receiving, retaining and spreading said hair treatment product, and generally is comprised of a series of tines. Such applicators are disclosed in U.S. Pat. No. 6,079,420, U.S. Pat. No. 6,142,157 and, more recently, in US 2004/0065338. All these applicators have a retaining structure which comprises a predetermined arrangement of tines. Such applicators with tines provide a consistent result from hair root to hair tip, and/or from strand to strand. However, such applicators with tines offer little or no flexibility as to the application pattern for the hair treatment product, whereas different areas of the hair might call for different application pattern. The second type of applicator comprises brushes with bristles instead of tines. Such applicators with bristles provide for the desired flexibility, however they do not provide for a consistent result from root to tip, or strand to strand. Therefore, currently there is no one applicator design that meets both these needs. It is thus an object of the present invention to provide an applicator which would address these shortcomings. In particular, it is an object of the present invention to provide an applicator for a hair treatment product, which allows some flexibility in the pattern of application of the hair treatment product, and which ensures a consistent application of hair treatment product, once a particular pattern has been chosen.

SUMMARY OF THE INVENTION

In its broadest embodiment, the present invention encompasses a hair treatment applicator (1) for applying a hair treatment product to hair, the applicator comprising:

- a handle (2) comprising a first extremity and a second extremity; and
- a first retaining structure (3*a*) and a second retaining structure (3*b*) for receiving, retaining and spreading said hair treatment product, both retaining structures being connected to said handle;

and said first retaining structure and said second retaining structure are located at said first extremity and second extremity, respectively, and said retaining structures are different from one another.

In a second embodiment, the present invention encompasses a kit-of-parts and a hair treatment product. In a third embodiment, the present invention encompasses a process of treating hair with a hair treatment product and the applicator of the invention.

DETAILED DESCRIPTION OF THE INVENTION

The Applicator

The applicator (1) of the present invention comprises a handle (2) with two extremities.

At the first extremity there is provided a first retaining structure (3*a*), and at the second extremity there is provided a second retaining structure (3*b*). Each of said retaining structures is able to receive and retain the hair treatment product that is to be applied onto the hair. By "retain", it is meant that the structure is able to prevent the hair treatment product from freely dripping from said structure, thus enabling the user to apply the product onto the hair before the product has dripped from the structure. To that end, each of said retaining structures can comprise a variety of elements such as a spongy material, or bristles or tines arranged on a supporting surface whose plane is generally perpendicular to the direction of said tines or bristles. In the preferred applicators of the invention, the retaining structures comprise a plurality of tines (6) arranged in a predetermined pattern on a supporting surface. Indeed, tines are considered most appropriate for a consistent pattern of application of the hair treatment product. Most preferably, both retaining structures comprise tines arranged along several parallel lines, on such a supporting surface. Comb-like structures, where tines are arranged along a single line without a supporting surface, are not considered suitable for the present invention.

Figure 1:
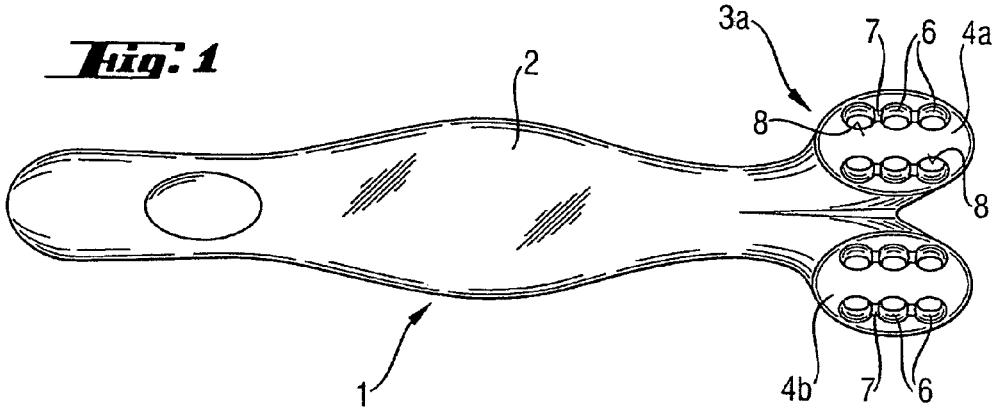
FIG. 1 is a bottom view of the applicator.
Figure 2:
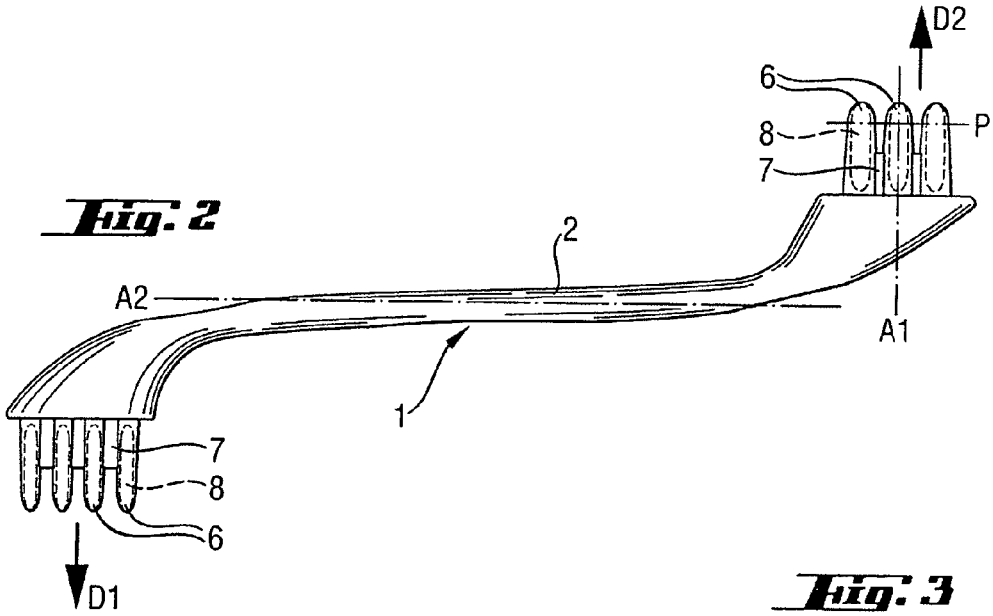
FIG. 2 is a side view of the applicator.
Figure 3:
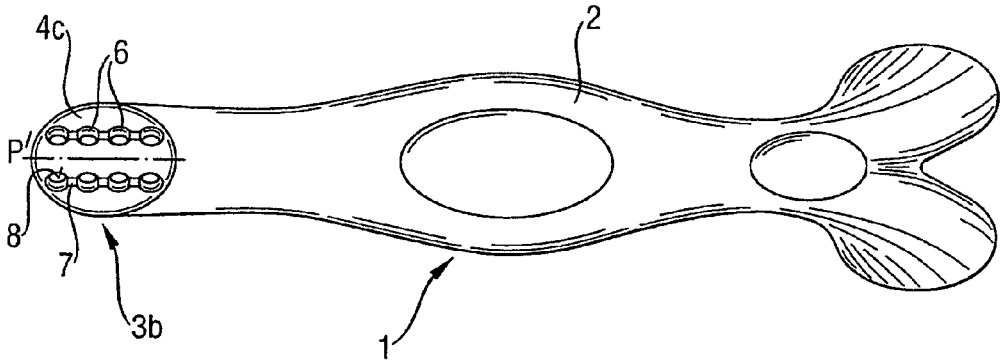
FIG. 3 is a top view of the applicator.

It is essential that the retaining structures which are located at the two extremities of the handle are different from one another, thus enabling flexibility in the pattern of application of the hair treatment product. The retaining structures can be different in any manner, provided that the two structures provide a different pattern of application of the product onto the hair. For instance, one structure could comprise a sponge and the other structure could comprise tines. In a preferred execution, however, both structures comprise tines, but the tines are arranged differently in the two retaining structures. In the most preferred embodiment of the invention, one of the retaining structures (3*a*) comprises two heads (4*a*,4*b*), and each of said heads comprises a plurality of tines (6), and the other retaining structure (3*b*) comprises only one head (4*c*), and said head comprises a plurality of tines (6). In the execution shown in FIG. 3, the arrangement and the size of the tines in the two structures are different, and the sizes of the structures themselves are also different. Structure (3*b*), in the execution in FIG. 3 allows a much more precise application of the hair treatment product, suitable for application to smaller sections of hair, or to hair on the back of the head.

In a preferred embodiment, there is provided at least one baffle (7) between the tines, substantially parallel to the longitudinal axis (A2) of the handle. The height of the baffle is preferably no more than about half the length of the tines. The baffle helps to retain the product after it has been applied to the structure, and before it is applied to hair. In a most preferred embodiment, there are baffles provided between all tines aligned parallel to the longitudinal axis of the handle.

In a preferred embodiment, the tines have a surface (8) which is concave towards the middle plane (P') of the head, in a cross section in a plane (P) parallel to the longitudinal axis (A1) of the tine. Indeed, we have found that such a concave structure helps draw product out along hair strands and prevents residual product hang up in the retaining structure.

In a preferred embodiment, the retaining structures (3*a*,3*b*) are facing in directions (D1,D2) which are generally opposite, and perpendicular to the longitudinal axis (A2) of the handle. Indeed, we have found that it is in this configuration that the applicator is most conveniently used, and only one of the retaining structures applies product to hair at any given point in time.

Any of the preferred features described herein (baffles, concave tines, retaining structures facing opposite directions) can also be used independently, i.e. on applicators which are not according to the invention. Such applicators are expressly disclosed in this statement so as to reserve the right to seek patent protection for such applicators in other patent applications claiming priority from this application for the subject matter which is disclosed here, or in divisionals from this patent application.

The Kit-Of-Parts:

In a second embodiment, the present invention encompasses a kit-of-parts comprising an applicator as described herein, and a hair treatment product. The hair treatment product is preferably a product for highlighting/dying/coloring strands/sections of hair. The kit-of-parts preferably further comprises usage instructions to perform the process described in the following section.

The Process:

In a third embodiment, the present invention encompasses a process of treating hair with a hair treatment product and an applicator as described herein. The process comprises the steps of applying the hair treatment product onto at least one of the retaining structures, then applying said retaining structure onto a selected strand or strands of hair, holding the applicator by the handle. Those two steps are repeated until all the hair that is to be treated has been treated. If the retaining structure still comprises some product after a strand of hair has been treated, then another strand of hair can be treated before some more product is applied onto the retaining structure.

The process of the present invention may further comprise additional and subsequent steps of applying said product onto the other retaining structure of the applicator, then applying said other retaining structure to another selected strand of hair, preferably one which has not been treated in the first steps, holding the applicator by the handle.

In a preferred embodiment of the present invention, the process is a process for highlighting strands of hair.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are the scope of this invention.

What is claimed is:

1. A combination hair treatment and hair treatment applicator for applying said hair treatment to hair comprising:

a hair treatment applicator comprising:

a handle;

a first retaining structure connected to said handle, said first retaining structure comprising:

a first head comprising a first base, a first plurality of tines extending from said first base, and at least one first baffle extending from said first base, which together are configured to hold said hair treatment, receive a first strand of hair, and apply said hair treatment to said first strand of hair;

a second head comprising a second base, a second plurality of tines extending from said second base, and at least one second baffle extending from said second base, which together are configured to hold said hair treatment, receive a second strand of hair, and apply said hair treatment to said second strand of hair;

a passage extending between said first and second baffles, wherein said passage is substantially free of said hair treatment and is configured to receive a third strand of hair without exposing said third strand of hair to hair treatment contained in said first and second heads;

a second retaining structure connected to said handle and disposed at an opposite end of said handle from said first retaining structure, said second retaining structure comprising:

a third head comprising a third base and a third plurality of tines extending from said third base, which together are configured to hold said hair treatment, receive a strand of hair, and apply said hair treatment to said strand of hair; and a hair treatment contained in the first or second retaining structures of the hair treatment applicator.

2. A combination hair treatment and hair treatment applicator according to claim 1, wherein said third head further comprises at least one baffle extending from said base.

3. A combination hair treatment and hair treatment applicator according to claim 1, wherein at least one tine in said first, second, or third plurality of tines comprises a concave inner surface.

4. A combination hair treatment and hair treatment applicator of claim 1, wherein said first plurality of tines is disposed on said first base such that each of said plurality of tines is comprised within a first row of two or more tines aligned in a direction substantially parallel to said longitudinal axis of said handle and a second row of two or more tines aligned in a direction substantially perpendicular to said longitudinal axis of said handle, wherein said second plurality of tines is disposed on said second base such that each of said plurality of tines is comprised within a first row of two or more tines aligned in a direction substantially parallel to said longitudinal axis of said handle and a second row of two or more tines aligned in a direction substantially perpendicular to said longitudinal axis of said handle, and wherein said third plurality of tines is disposed on said third base such that each of said plurality of tines is comprised within a first row of two or more tines aligned in a direction substantially parallel to said longitudinal axis of said handle and a second row of two or more tines aligned in a direction substantially perpendicular to said longitudinal axis of said handle.

* * * * *

UNITED STATES PATENT AND TRADEMARK OFFICE

CERTIFICATE OF CORRECTION

PATENT NO. : 7,597,106 B2
APPLICATION NO. : 11/359716
DATED : October 6, 2009
INVENTOR(S) : Desmond et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 761 days.

Signed and Sealed this

Twenty-eighth Day of September, 2010

David J. Kappos

David J. Kappos
*Director of the United States Patent and Trademark Office*